US010306709B2

(12) United States Patent
Zhu

(10) Patent No.: US 10,306,709 B2
(45) Date of Patent: May 28, 2019

(54) TRIMMABLE HEAT BLANKET AND HEATING METHOD

(71) Applicant: The Boeing Company, Chicago, IL (US)

(72) Inventor: Alex X. Zhu, Charleston, SC (US)

(73) Assignee: The Boeing Company, Chicago, IL (US)

( * ) Notice: Subject to any disclaimer, the term of this patent is extended or adjusted under 35 U.S.C. 154(b) by 174 days.

(21) Appl. No.: 15/432,143

(22) Filed: Feb. 14, 2017

(65) Prior Publication Data

US 2018/0235031 A1 Aug. 16, 2018

(51) Int. Cl.

| | |
|---|---|
| ***H05B 3/36*** | (2006.01) |
| ***H05B 3/34*** | (2006.01) |
| ***B26D 7/00*** | (2006.01) |
| ***H05B 1/02*** | (2006.01) |

(52) U.S. Cl.

CPC ..... *H05B 3/36* (2013.01); *B26D 7/00* (2013.01); *H05B 1/0236* (2013.01); *H05B 3/34* (2013.01); *H05B 2203/005* (2013.01)

(58) Field of Classification Search

CPC ..... H05B 1/0236; H05B 3/34; H05B 3/342; H05B 3/345; H05B 3/347; H05B 3/36

USPC ..... 219/478

See application file for complete search history.

(56) References Cited

U.S. PATENT DOCUMENTS

| | | | | |
|---|---|---|---|---|
| 4,352,707 | A | 10/1982 | Wengler et al. | |
| 5,442,156 | A | 8/1995 | Westerman et al. | |
| 6,031,212 | A | 2/2000 | Westerman et al. | |
| 6,084,206 | A * | 7/2000 | Williamson | H05B 3/146 219/212 |
| 6,373,028 | B2 * | 4/2002 | Williamson | H05B 3/146 219/212 |
| 8,546,732 | B2 | 10/2013 | Singh | |
| 8,886,026 | B2 * | 11/2014 | Gilad | F24D 13/024 219/528 |
| 2002/0038800 | A1 * | 4/2002 | Laken | A47J 36/2483 219/476 |
| 2003/0234247 | A1 | 12/2003 | Stern | |
| 2016/0143092 | A1 | 5/2016 | Miller et al. | |
| 2016/0198776 | A1 | 7/2016 | Stevens et al. | |

FOREIGN PATENT DOCUMENTS

| | | | |
|---|---|---|---|
| WO | WO2009146429 | A1 | 12/2009 |
| WO | WO2011128899 | A2 | 10/2011 |
| WO | WO2017007622 | A1 | 1/2017 |

OTHER PUBLICATIONS

Extended European Search Report, dated Jun. 18, 2018, regarding Application No. 17203822.6, 7 pages.

* cited by examiner

*Primary Examiner* — Brian W Jennison

(74) *Attorney, Agent, or Firm* — Yee & Associates, P.C.

(57) ABSTRACT

An electrical heat blanket includes an array of individual resistive heating element circuits that are spaced apart from each other. The heat blanket is trimmed to a desired size and/or shape by severing the blanket along cut lines between the circuits.

20 Claims, 11 Drawing Sheets

TRIMMABLE HEAT BLANKET AND HEATING METHOD

BACKGROUND INFORMATION

1. Field

The present disclosure generally relates to equipment and methods for heating a structure, and deals more particularly with an electrical heat blanket that can be trimmed to a desired shape and/or size, and a method of using the blanket to heat a structure.

2. Background

Electrical heat blankets are used to provide surface heating of structures and parts in a variety of applications. For example, heat blankets are used to cure composite patches placed on a structure requiring repair. These heat blankets, which use electrically powered resistive heating elements, are manufactured in standard sizes and shapes.

In some applications, such as curing a repair patch on an aircraft, a heat blanket matching the size of the repair area may not be available. Consequently, if an oversized heat blanket is used, it must be folded over or otherwise temporarily modified in order to only apply heat to the desired coverage area.

The use of an oversized heat blanket also may increase the risk of overheating a repair area, and/or a nearby heat sensitive structure. Custom sized heat blankets can be fabricated, but the lead time needed to design and produce them may be too long for applications such as in-service aircraft repairs requiring immediate attention.

SUMMARY

The disclosure relates in general to equipment and methods for local surface heating of a structure, such as a composite repair patch on an aircraft, and more specifically to an electrical heat blanket that can be trimmed to a desired size and/or shape. The disclosure also relates to a method of heating a structure using the heat blanket.

According to one aspect, a heating apparatus comprises a blanket and an array of individual resistive heating element circuits inside the blanket. The individual resistive heating element circuits are configured to be coupled with a source of electrical power, and are spaced apart from each other to allow the blanket to be cut to a desired shape and/or size.

According to another aspect, a heat apparatus comprises a heat blanket and a resistive heating element circuit embedded therein. The resistive heating circuit is configured to be coupled with a source of electrical power and includes a plurality of individual resistive heating element circuits arranged in a configuration that allows the heat blanket to be cut to a desired shape and/or size while maintaining electrical continuity.

According to still another aspect, a method is provided of making a heating apparatus. The method comprises providing an electrical heat blanket having an array of individual resistive heating element circuits therein that are adapted to be coupled with a source of electrical power. The method further also includes trimming the electrical heat blanket to a desired shape, including removing at least certain of the individual resistive heating element circuits.

One of the advantages of the disclosed heat blanket is that it can be quickly and easily trimmed to a desired shape and/or size. Another advantage of the heat blanket is that it avoids overheating a structure, or damaging nearby heat sensitive components. A further advantage lies in elimination of the need for custom made heat blankets, and the long lead times required to fabricate such blankets.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

DETAILED DESCRIPTION

Figure 1:
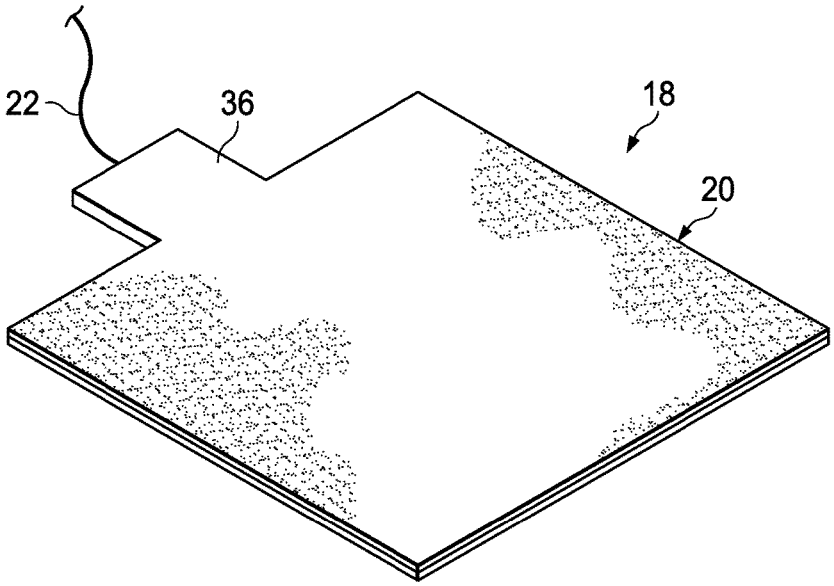
FIG. 1 is an illustration of a perspective view of a trimmable heat blanket.
Figure 2:
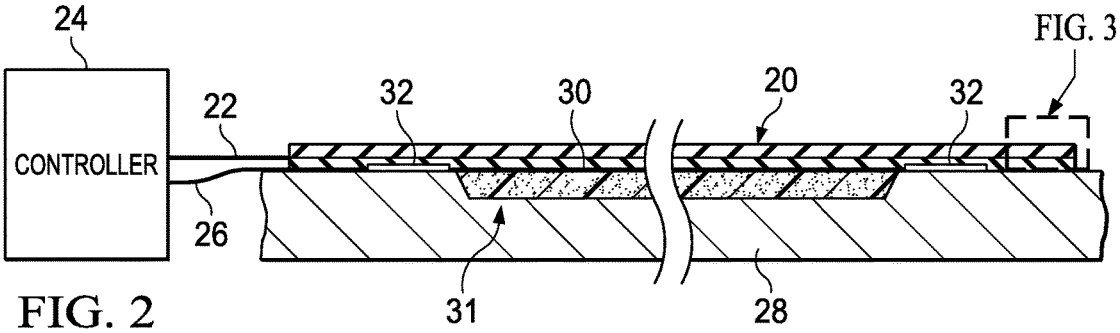
FIG. 2 is an illustration of a combined block and diagrammatic side view of the heat blanket of FIG. 1, installed over a composite repair patch.
Figure 3:
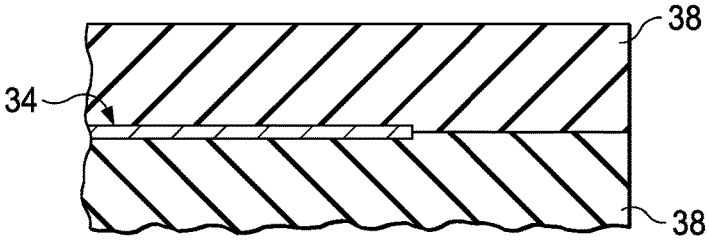
FIG. 3 is an illustration of the area designated as "FIG. 3" in FIG. 2.

Referring first to FIGS. 1-3, heating apparatus 18 in the form of a flexible, electrical heat blanket 20 is coupled by external power and control lines to a controller 24 which includes a source of electrical power (not shown). In one embodiment, the heat blanket 20 comprises a resistive heating element circuit 34, which may comprise a printed flex circuit, embedded in and laminated between two layers of flexible material 38. Each of the two layers of flexible material 38 may comprise a vulcanized silicone rubber reinforced with a layer (not shown) of fiberglass. Depending on the application, the flexible material 38 may comprise latex rubber or any of various other elastomers. In still other applications, the flexible material 38 may comprise polyimide, Kapton® or other flexible films. While two layers of flexible material 38 are depicted in the exemplary embodiment, the resistive heating element circuit 34 may be embedded in a single layer of flexible material 38, as by insert molding. The resistive heating element circuit 34 includes a series of later discussed electrical leads (not shown) coupled to one or more bus bars (not shown) that are connected to the external power and control lines 22 via an entry tab 36 on the heat blanket 20.

In one application, shown in FIG. 2, the blanket 20 is placed on a structure 28, such as a skin of an aircraft, overlying a composite repair patch 30 that requires thermal curing according to a predefined cure schedule. As will be discussed below, the heat blanket 20 can be easily specifically tailored to the size and shape of a repair area 31 containing the composite repair patch 30. Depending on the application, one or more thermocouples 32 may be placed beneath the heat blanket 20, immediately outside the edges of the repair patch 30. The thermocouples 32 are coupled by electrical lines 26 to the controller 24. The controller 24 receives signals from the thermocouples 32 representing the sensed temperature of the heat blanket 20. Based on this sensed temperature, controller 24 adjusts AC power supplied to the heat blanket 20 in a manner that controls the temperature of the heat blanket 20 according to the cure schedule.

Figure 4:
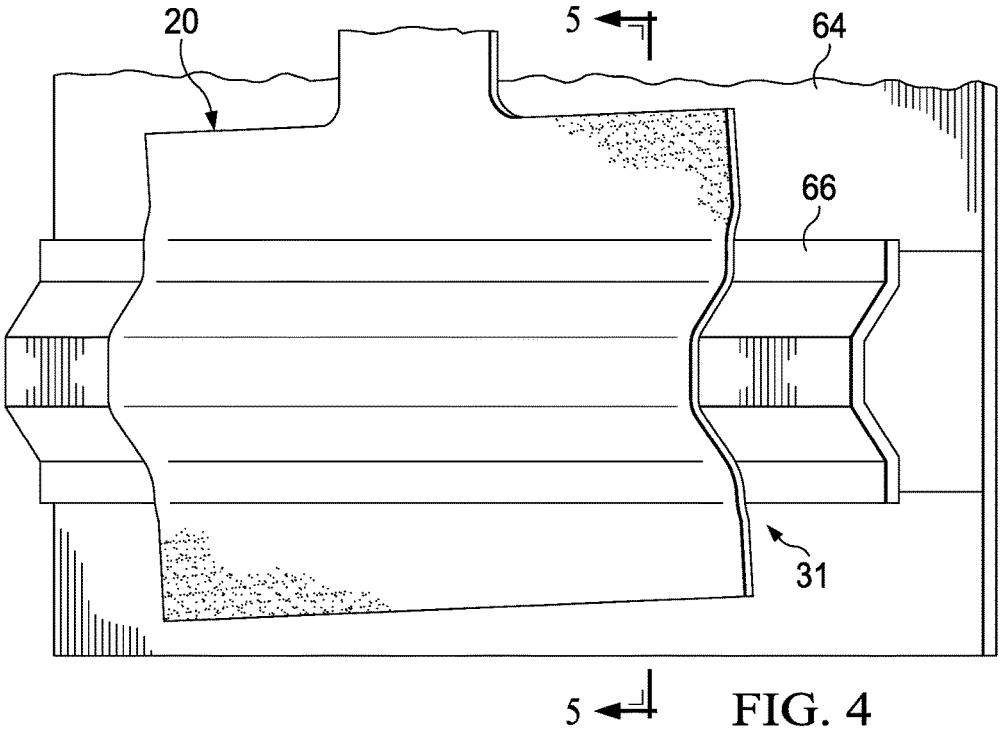
FIG. 4 is an illustration of a plan view of the heat blanket installed in a repair area on an aircraft skin.
Figure 5:
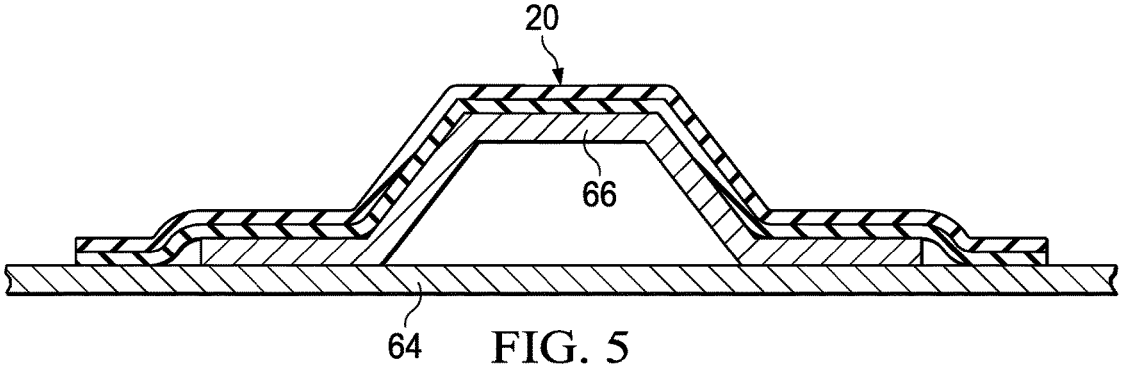
FIG. 5 is an illustration of a sectional view taken along the line 5-5 in FIG. 4.

FIGS. 4 and 5 illustrate a typical application of the flexible heat blanket 20 that has been trimmed to size. In this example, the heat blanket 20 has been trimmed to a width that wraps over and extends slightly beyond the edges of a stringer 66 on a skin 64, and a length that is sufficient to cover an underlying repair area 31. Due to its flexibility, the heat blanket 20 conforms to the contour of the stringer 66 and to the skin 64.

Figure 6:
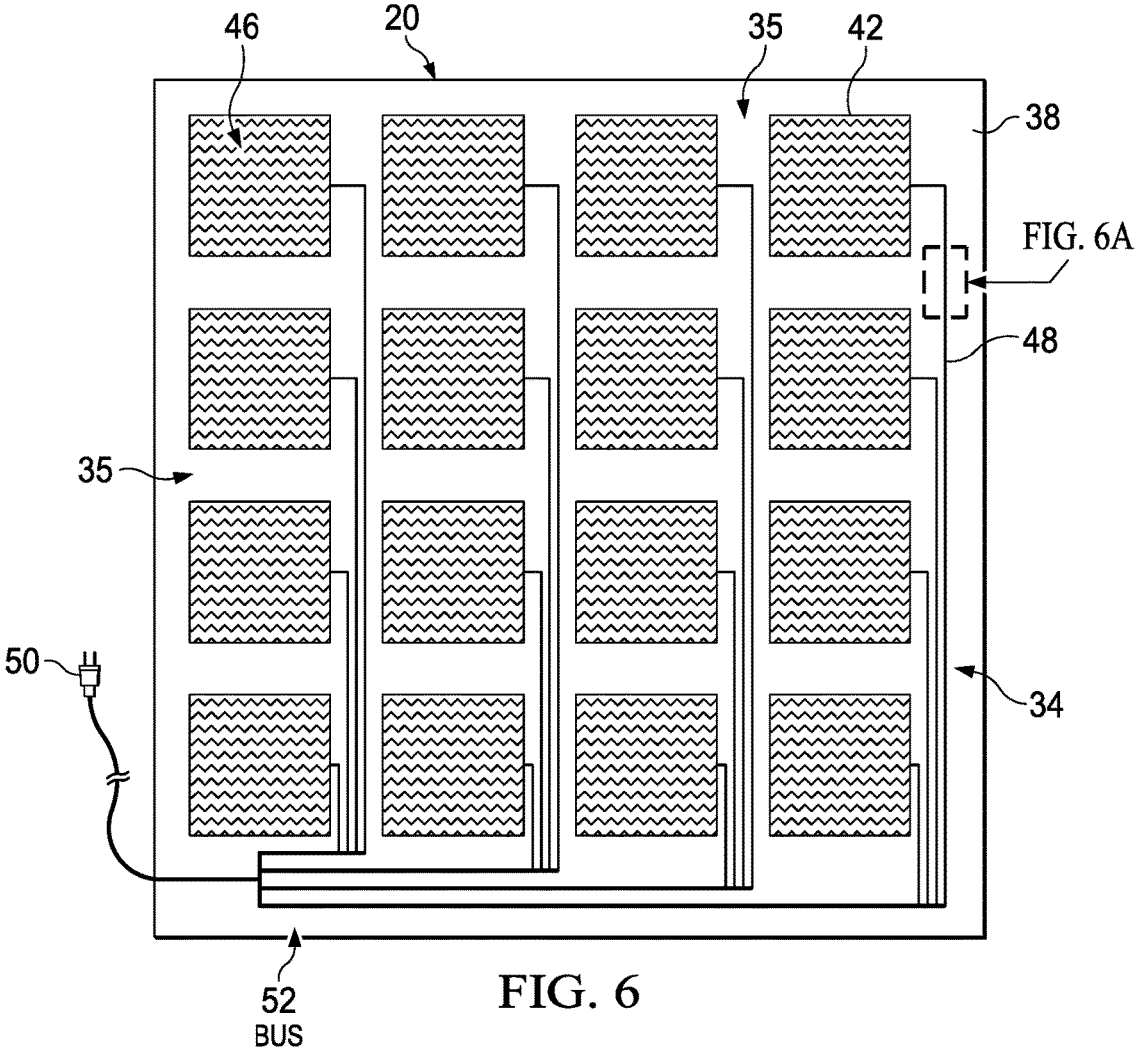
FIG. 6 is an illustration of a plan view of one embodiment of the heat blanket having a two-dimensional array of individual heating element circuits.
Figure 6A:
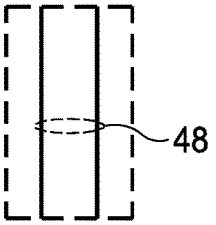
FIG. 6A is an illustration of the area designated as "FIG. 6A" in FIG. 6.

Referring to FIG. 6, in one embodiment, the resistive heating element circuit 34 comprises an N×M, two-dimensional array 46 of individual resistive heating element circuits 42, arranged in aligned N rows and M columns. In the illustrated embodiment, the individual resistive heating element circuits 42 are substantially identical in size and shape. In other embodiments discussed below, the resistive heating element circuit 34 may comprise a one-dimensional array 62 (see FIG. 12) of individual resistive heating element circuits 42. In the example shown in FIG. 6, the circuits are arranged in a 4×4 two-dimensional array 46, however in other embodiments the array 46 may contain any number of individual resistive heating element circuits 42. Additionally, while a regular, rectilinear array 46 is illustrated, the individual resistive heating element circuits 42 may be arranged in an irregular array or in an array that is not rectilinear. Any of various array geometries are possible. Moreover, the individual resistive heating element circuits 42 may be any size suitable for the application, and while they are identical in size in the illustrated example, in other embodiments, the array may contain resistive heating elements circuits 42 having differing sizes. Each of the individual circuits 42 is independently connected by a pair of electrical lines 48 (see FIG. 6A) to an electrical bus 52 which in turn is connected to the controller 24 by a suitable electrical coupling. Thus, it may be appreciated that the individual circuits 42 are connected to the power source in parallel with each other. Alternatively, the bus 52 may be connected to a simple electrical plug 50 that can be inserted into an AC power outlet (not shown). The individual circuits 42 are spaced apart from each other at a distance "D". Due to the alignment of the individual circuits 42 in the array 46, the spacing 35 between the individual circuits 42 is substantially constant and occur at regular intervals throughout the array 46.

Figure 7:
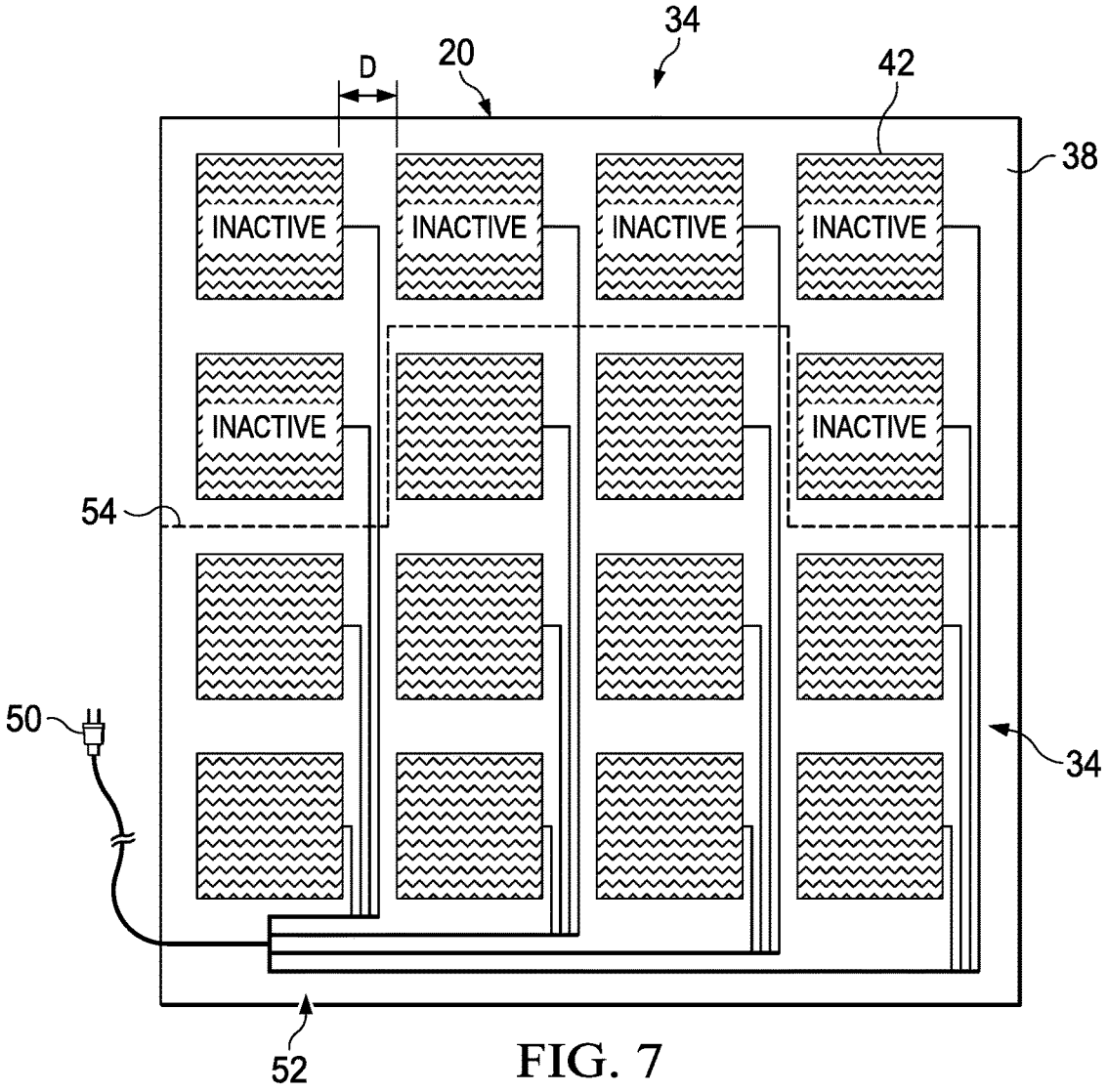
FIG. 7 is an illustration of a view similar to FIG. 6 but showing cut lines allowing the heat blanket to be trimmed to a desired shape.
Figure 8:
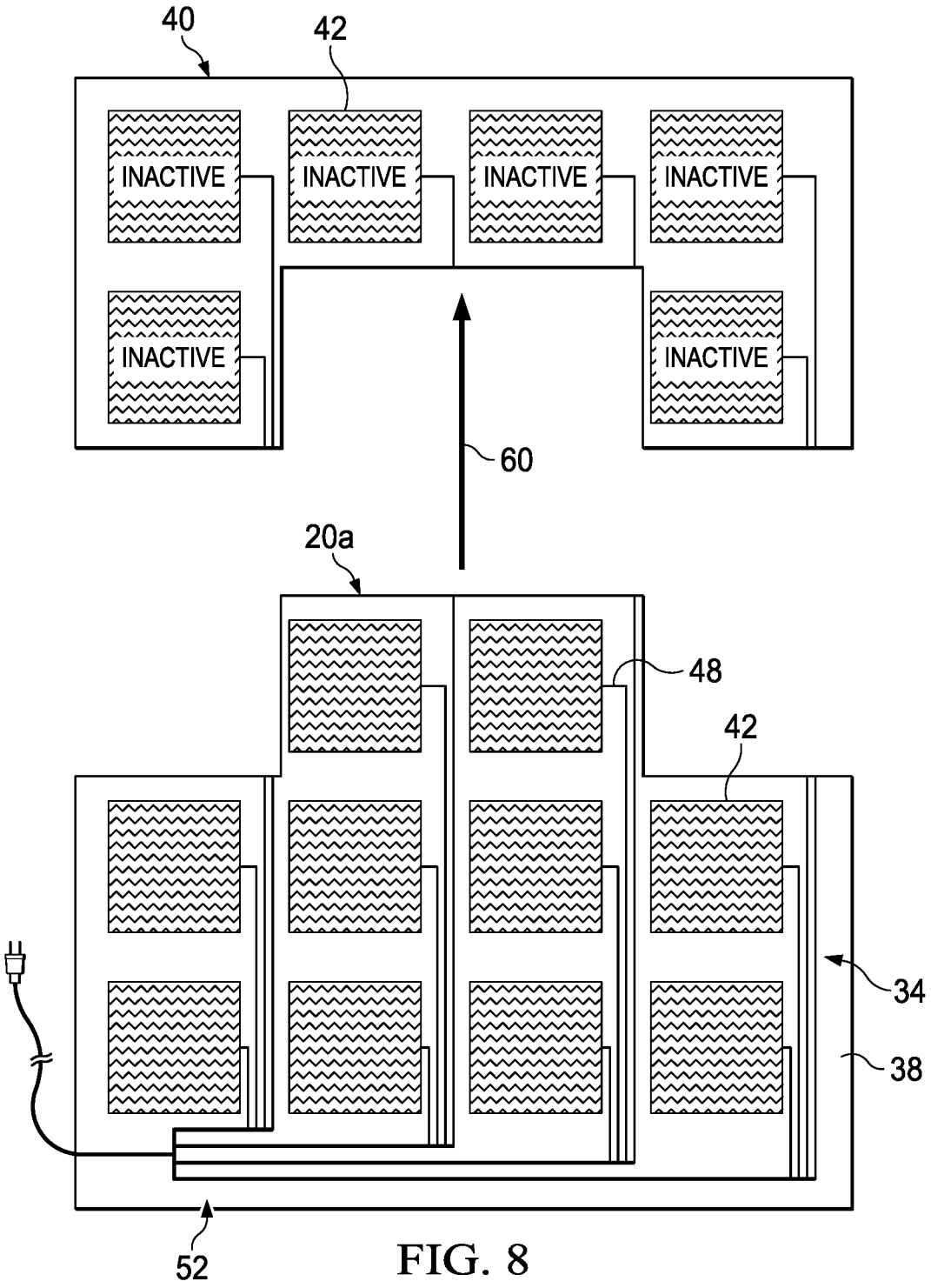
FIG. 8 is an illustration showing the heat blanket having been trimmed to the desired shape, along with a scrap section that has been cut away.

The provision of regular spacing 35 throughout the array 46 in the illustrated embodiments assists a technician in trimming the heat blanket 20 trimmed to a desired shape and/or size suitable for individual applications, while maintaining electrical continuity of the electrical heating circuit. In other embodiments, the spacing 35 between the individual circuits 42 may not be regular. The heat blanket 20 is trimmed to size by cutting or otherwise severing portions of the heat blanket 20 along cut lines 54 (FIG. 7) within the spacing 35 between the individual circuits 42. The cut lines 54 may be printed, embossed or otherwise formed on the outside surface of the heat blanket 20, thus providing a visual guide that allows a technician to cut the heat blanket 20 to the desired shape without impairing its functionality. This cutting operation may be performed using a knife, scissors or other suitable cutting devices. In the example shown in FIGS. 7 and 8, six of the individual circuits 42 are cut away on the cut line 54, forming a scrap or unused section 40 that may be separated 60, leaving a trimmed heat blanket 20*a* having a size and shape that is tailored for the application. By following visible cut lines 54 on the heat blanket 20, the cutting operation renders those individual circuits inactive in the unused section 40, while individual circuits 42 in the trimmed heat blanket 20*a* each remain active since they remain electrically connected with the power source.

Figure 9:
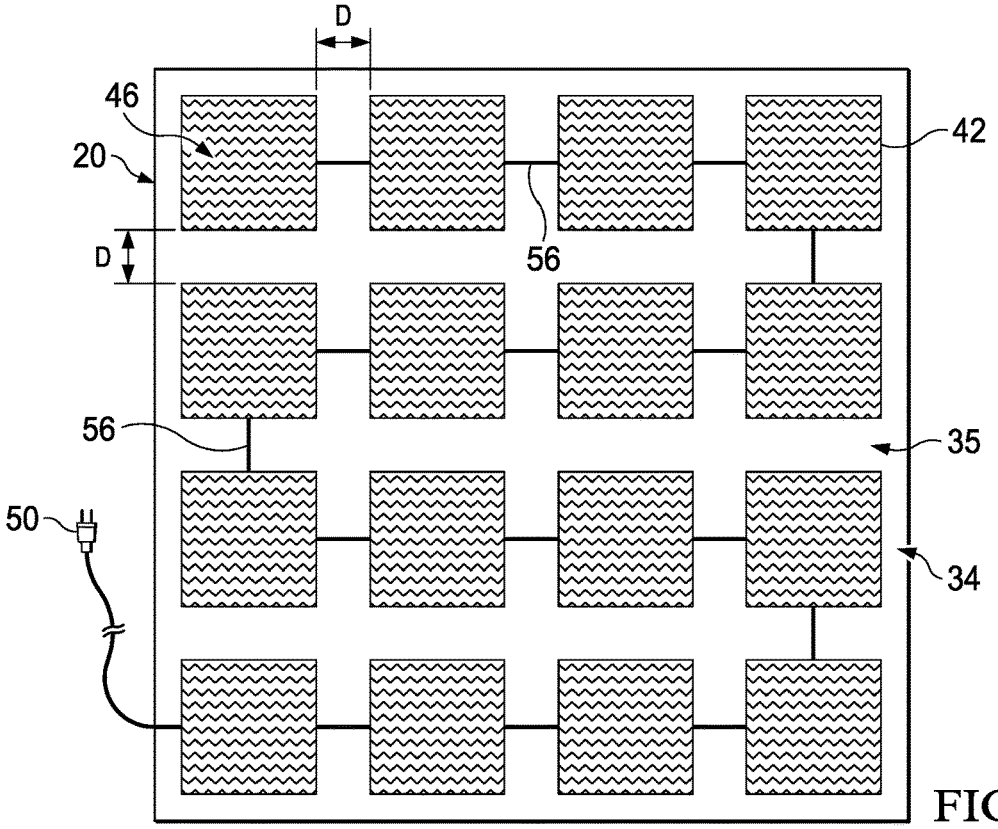
FIG. 9 is an illustration of a plan view of another embodiment of the heat blanket.
Figure 10:
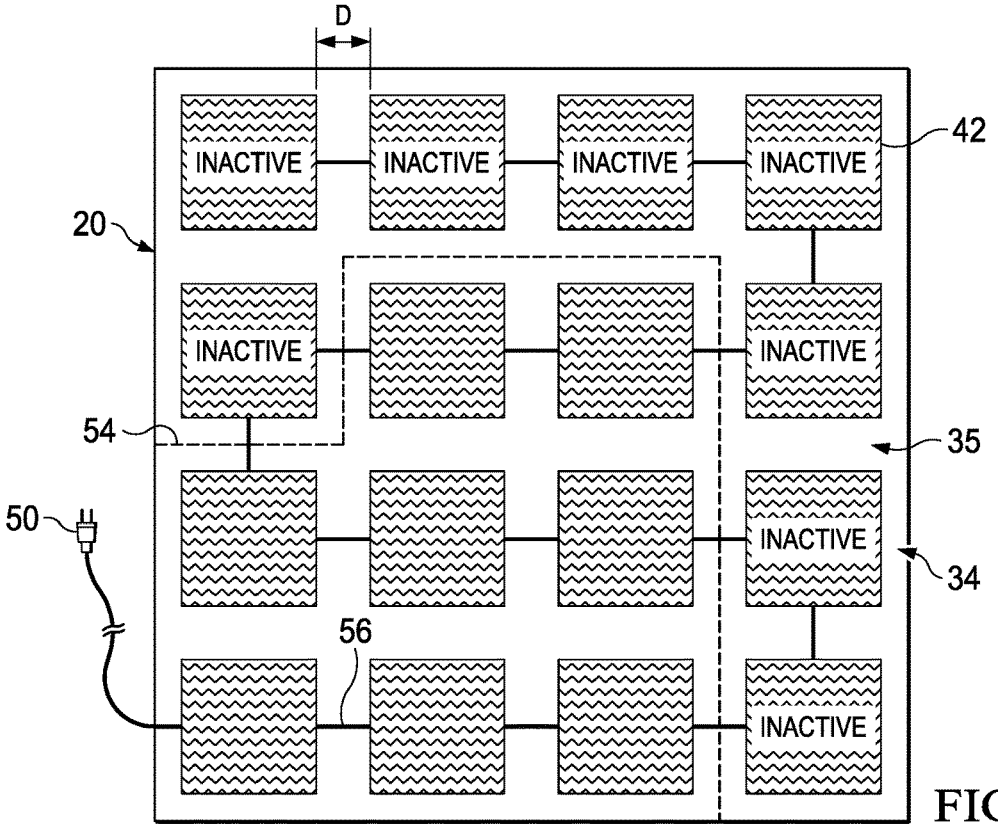
FIG. 10 is an illustration similar to FIG. 8 but showing cut lines allowing the heat blanket to be trimmed to a desired shape.
Figure 11:
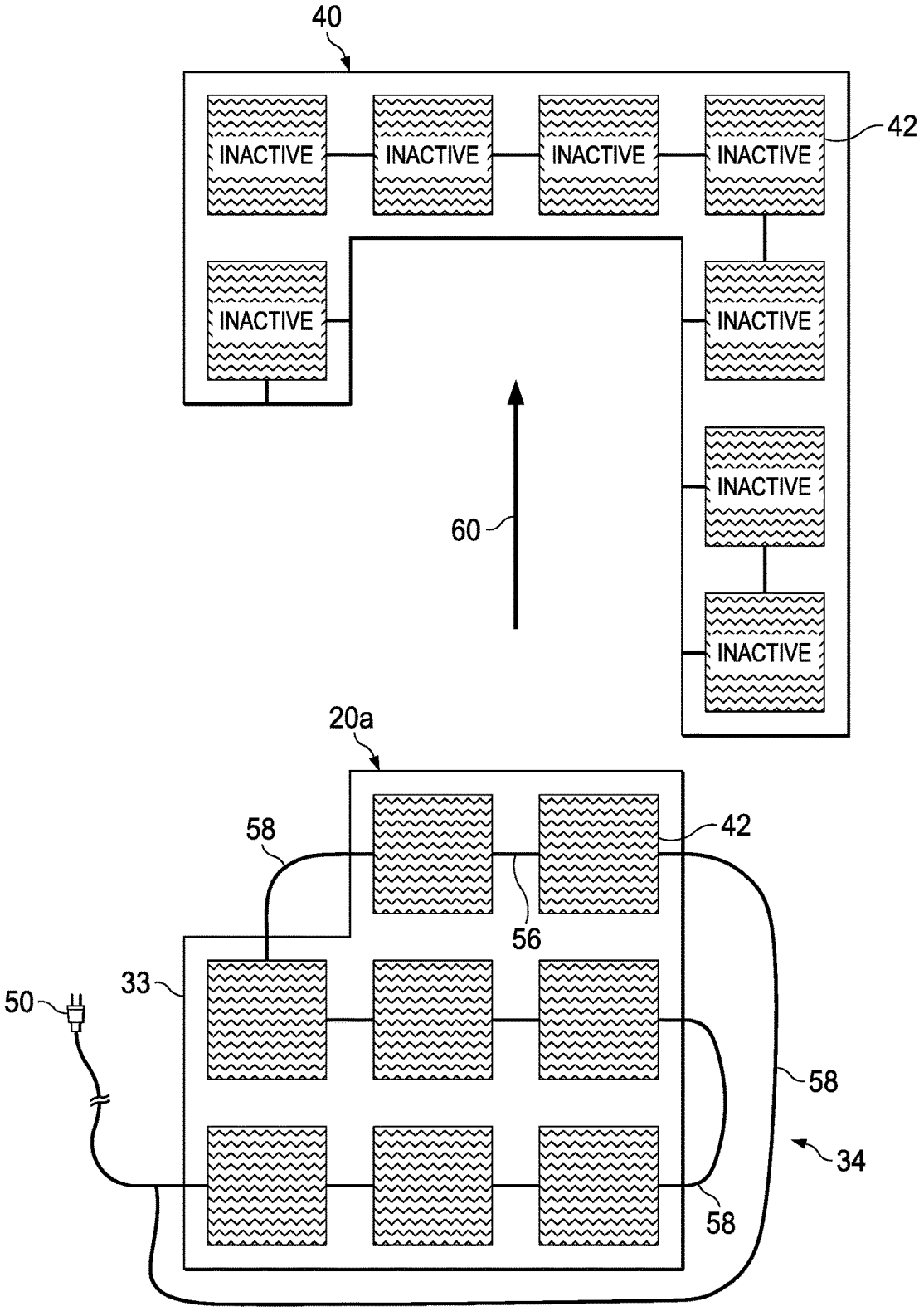
FIG. 11 is an illustration showing the heat blanket of FIGS. 9 and 10, after being trimmed to the desired shape, along with a scrap section that has been cut away, wherein electrical jumper wires have been installed to reestablish electrical continuity.

Attention is directed to FIGS. 9-11 which illustrate another embodiment of the trimmable heat blanket 20. In this example, the individual circuits 42 are connected to each other by electrical interconnect leads 56 which couple individual circuits 42 in a series circuit with the power source. In FIG. 10, a cut line has been chosen that results in eight of the individual circuits 42 being separated 60 (FIG. 11) from the heat blanket 20*a* when trimmed to size. However, cutting away these individual circuits severs several of the electrical interconnect leads 56 between the individual circuits 42 which are to remain active. In order to maintain electrical continuity within the series circuit containing the active individual circuits 42, jumper wires 58 are installed where necessary to interconnect the individual circuits 42 that have severed interconnect leads 56.

Figure 12:
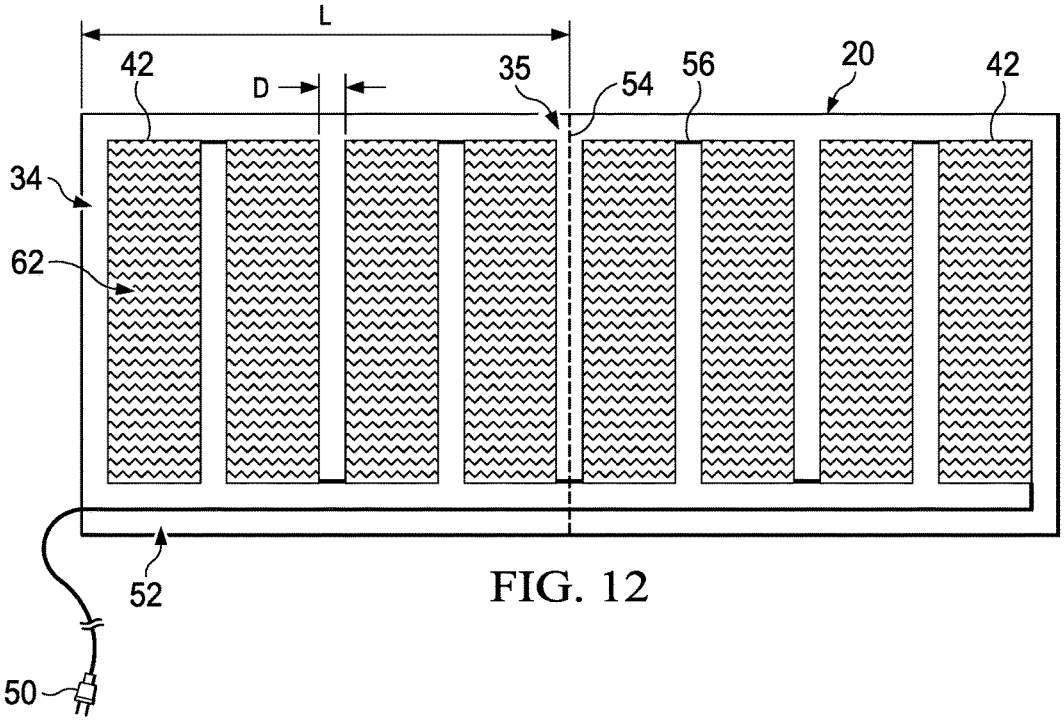
FIG. 12 is an illustration of a further embodiment of the heat blanket containing a one-dimensional array of individual electrical heating element circuits.
Figure 13:
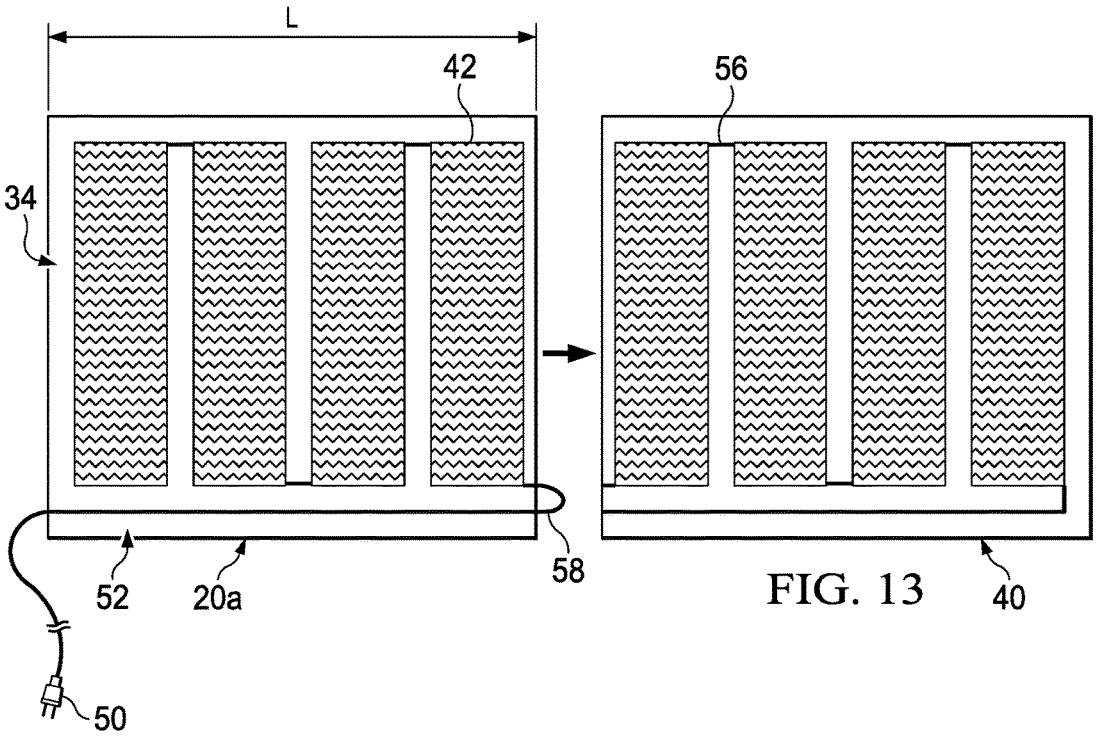
FIG. 13 is an illustration of the heat blanket shown in FIG. 12 after being trimmed to shape.

FIGS. 12 and 13 illustrate another embodiment of the heat blanket 20 in which the individual circuits are arranged as a linear, one-dimensional array 62, suitable for use in applications such as the composite repair example shown in FIGS. 4 and 5. In this embodiment, the individual circuits 42 are connected in series with each other, however, in other examples they be connected in parallel with each other, similar to the example shown in FIG. 6. The heat blanket 20 may be trimmed to a desired length "L" by severing it along a cut line 54 within the spacing 35 between adjacent ones of the individual circuits 42. In the series connected circuit 34 shown in FIG. 12, cutting the heat blanket along the cut line 54 breaks electrical continuity within the circuit 34. Referring to FIG. 13, after separating the section 40 of unused individual circuits 42 from the trimmed heat blanket 20*a*, electrical circuit continuity is restored by connecting a jumper wire 58 between the last individual circuit in the array 62 and the power source. In examples where the individual sub-circuits 42 are connected in parallel with each other, rather than in series, each such sub-circuit 42 is individually connected with the power source, consequently all of the sub-circuits 42 in the tailored blanket 20*a* remain connected with the power source after trimming, thus obviating the need for a jumper 58.

Figure 14:
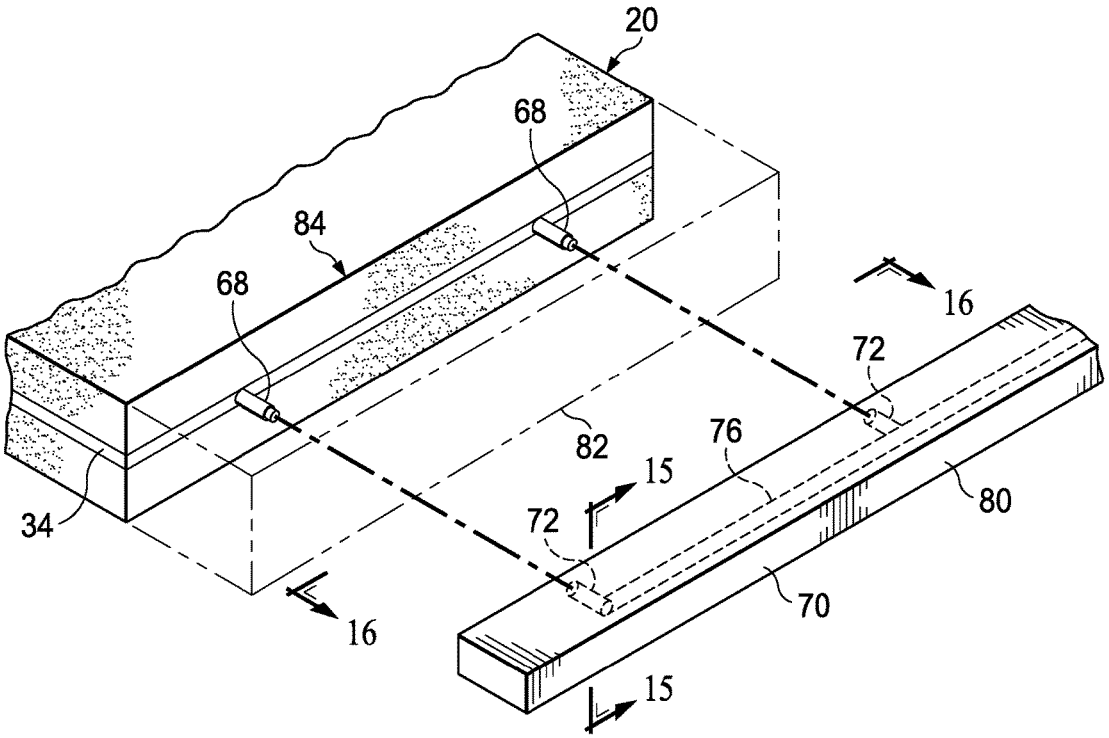
FIG. 14 is an illustration of a perspective view of an edge the heat blanket and an electrical connector module, a portion of the edge having been stripped away to reveal the ends of electrical leads.
Figure 15:
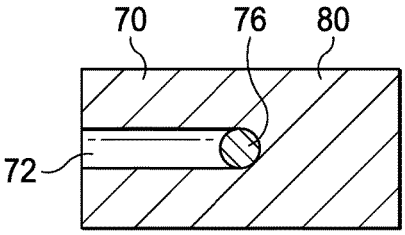
FIG. 15 is an illustration of a sectional view taken along the line 15-15 in FIG. 14.
Figure 16:
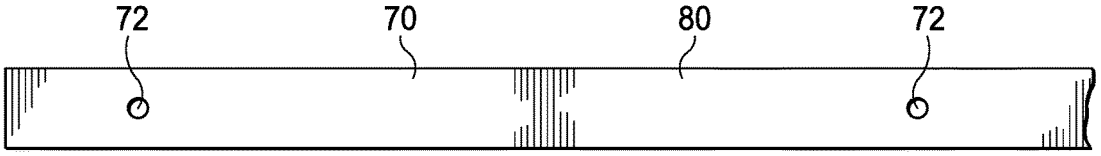
FIG. 16 is an illustration of a side view of the electrical connector module, viewed in the direction designated as "FIG. 16" in FIG. 14.

Attention is now directed to FIGS. 14-16 which illustrate one embodiment of a prefabricated electrical connector module 70 that may be used in lieu of jumper wires 58 to reestablish electrical continuity in a heat blanket 20 that has been trimmed to size/shape. The connector modules 70 may be made in standard sizes so as to be geometrically compatible with a standard grid spacing and sub-circuit size for a given heat blanket 20, such that they can be snapped onto the ends of the electrical leads 56 wherever needed to reestablish electrical continuity that has been interrupted as a result of cuts made in the heat blanket 20. The connector module 70 may be formed of any suitable nonconductive material such as a molded plastic that does not soften or degrade when subjected to the temperatures produced by the heat blanket 20. In the illustrated example, the connector module 70 has a substantially straight body 80 and is used to connect exposed ends of electrical leads (see FIG. 12) that have been severed as result of a trimming operation. The connector module 70 includes a pair of electrically conductive sockets 72 in one side thereof which are connected together by an internal conductor 76. The sockets 72 are spaced apart a distance that substantially matches the distance between exposed conductor ends 68. In use, a section 82 of the blanket 20 along an edge 84 of the heat blanket 20 is stripped away using any suitable technique, exposing the conductor ends 68. Then, the conductor ends 68 are electrically reconnected by plugging them into the sockets 72 of the connector module 70. Effectively, the connector module 70 is "snapped" onto the exposed conductor ends 68.

Figure 17:
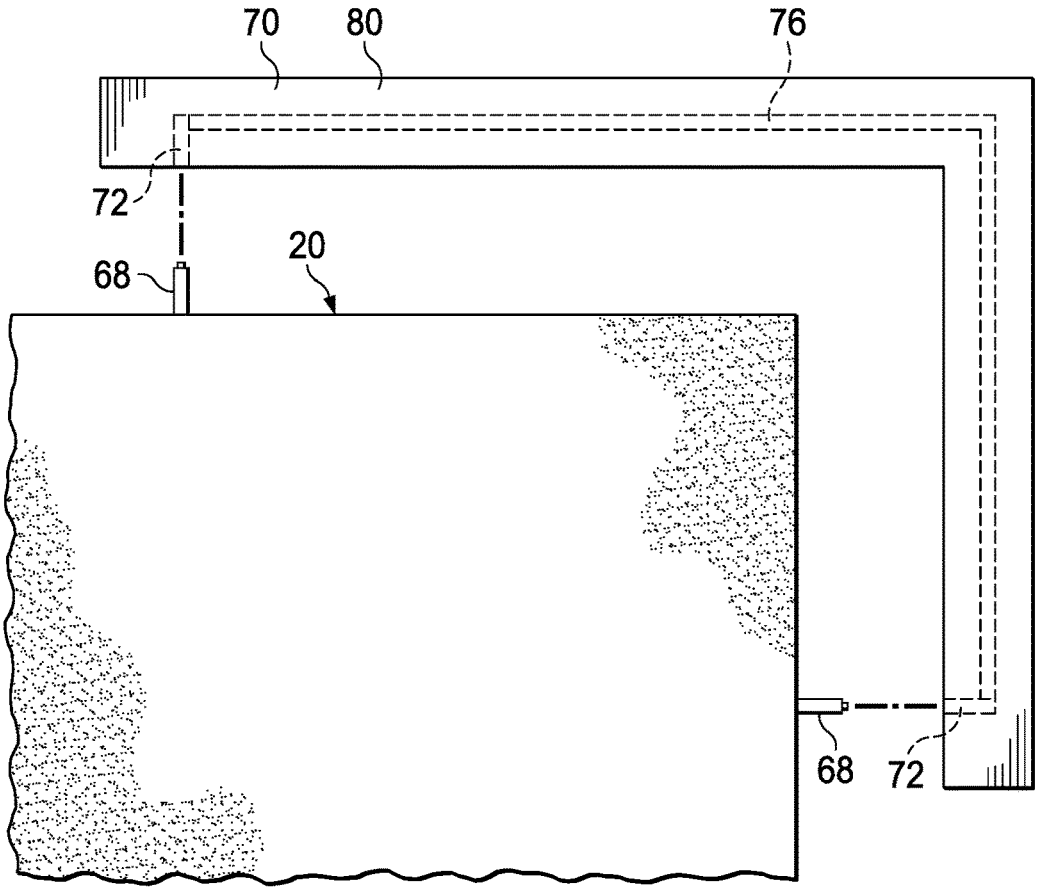
FIG. 17 is an illustration of a plan view of a corner of a heat blanket, showing the use of another form of the electrical connector module.

FIG. 17 illustrates an alternate form of a connector module 70 that has a substantially L-shaped body 80, an internal conductor 76 and electrical sockets 72. The electrical sockets 72 are positioned to receive exposed conductor ends 68 on two sides of heat blanket 20.

Figure 18:
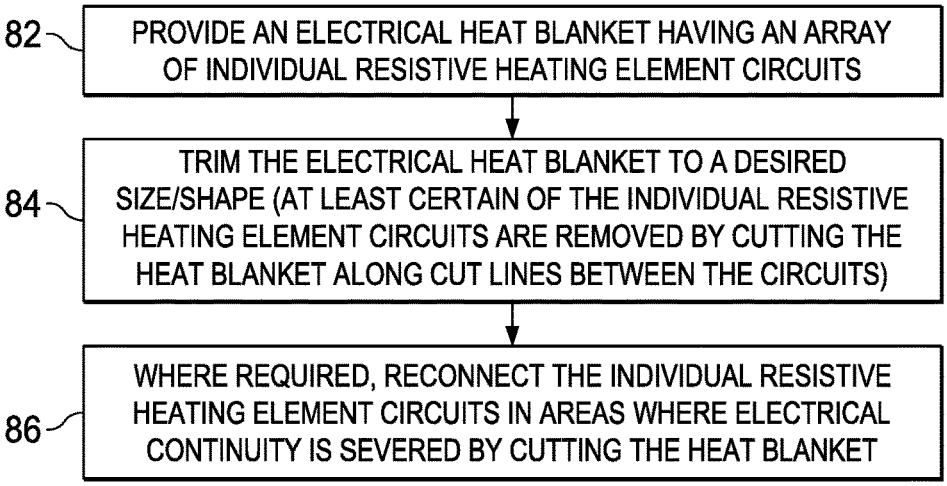
FIG. 18 is an illustration of a flow diagram of a method of heating a structure using the trimmable heat blanket.

FIG. 18 broadly illustrates a method of making a heating apparatus 28 using the trimmable heat blanket 20 described above. At 82, an electrical heat blanket 20 is provided having an array of resistive heating element circuits 42. At 84, the electrical heat blanket 20 is trimmed to a desired size and/or shape. During the trimming operation, at least certain of the resistive heating element circuits are removed by cutting the heat blanket 20 along cut lines within spacing 35 between the individual circuits 42. At 86, where necessary, the individual circuits 42 are reconnected in those areas where electrical continuity has been severed as result of cutting heat blanket 20 to the desired size and/or shape.

Figure 19:
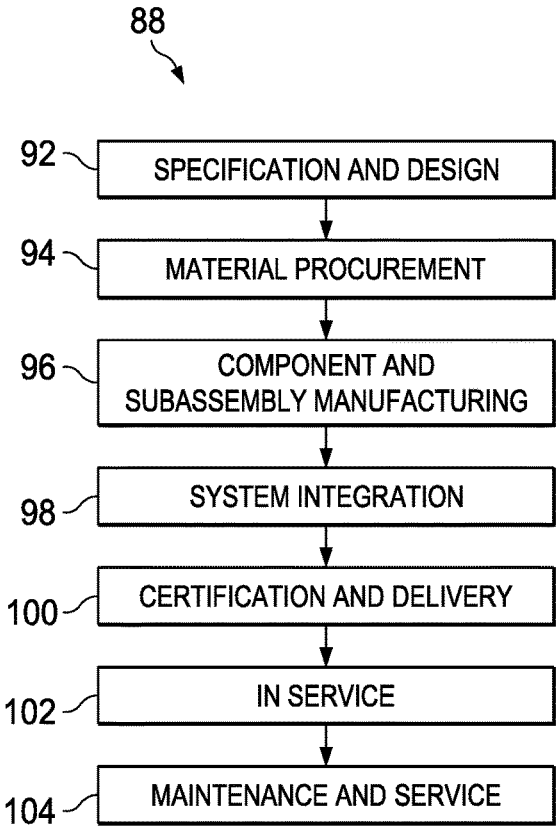
FIG. 19 is an illustration of a flow diagram of aircraft production and service methodology.
Figure 20:
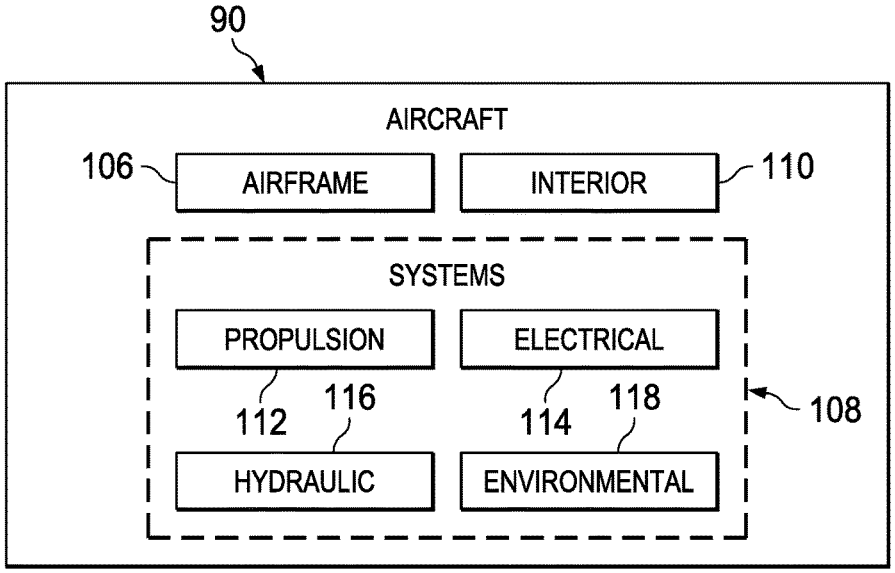
FIG. 20 is an illustration of a block diagram of an aircraft.

Embodiments of the disclosure may find use in a variety of potential applications, particularly in the transportation industry, including for example, aerospace, marine, automotive applications and other application where pressurized fluid tubes, such as fuel systems and hydraulic systems in aircraft, may be used. Thus, referring now to FIGS. 19 and 20, embodiments of the disclosure may be used in the context of an aircraft manufacturing and service method 88 as shown in FIG. 19 and an aircraft 90 as shown in FIG. 20. Aircraft applications of the disclosed embodiments may include, for example, without limitation, thermal curing of composite repairs on various parts of the airframe 106. During pre-production, exemplary method 88 may include specification and design 92 of the aircraft 90 and material procurement 94. During production, component and subassembly manufacturing 96 and system integration of the aircraft 90 takes place. Thereafter, the aircraft 90 may go through certification and delivery 100 in order to be placed in service 102. While in service by a customer, the aircraft 90 is scheduled for routine maintenance and service 104, which may also include modification, reconfiguration, refurbishment, and so on.

Each of the processes of method 88 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 20, the aircraft 90 produced by exemplary method 88 may include an airframe 106 with a plurality of systems 108 and an interior 110. Examples of high-level systems 108 include one or more of a propulsion system 112, an electrical system 114, a hydraulic system 116 and an environmental system 118. Any number of other systems may be included. Although an aerospace example is shown, the principles of the disclosure may be applied to other industries, such as the marine and automotive industries.

Systems and methods embodied herein may be employed during any one or more of the stages of the production and service method 88. For example, components or subassemblies corresponding to production process 96 may be fabricated or manufactured in a manner similar to components or subassemblies produced while the aircraft 90 is in service. Also, one or more apparatus embodiments, method embodiments, or a combination thereof may be utilized during the production stages 96 and 98, for example, by substantially expediting assembly of or reducing the cost of an aircraft 90. Similarly, one or more of apparatus embodiments, method embodiments, or a combination thereof may be utilized while the aircraft 90 is in service, for example and without limitation, to maintenance and service 104.

As used herein, the phrase "at least one of", when used with a list of items, means different combinations of one or more of the listed items may be used and only one of each item in the list may be needed. For example, "at least one of item A, item B, and item C" may include, without limitation, item A, item A and item B, or item B. This example also may include item A, item B, and item C or item B and item C. The item may be a particular object, thing, or a category. In other words, at least one of means any combination items and number of items may be used from the list but not all of the items in the list are required.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different advantages as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A heating apparatus that comprises:

a blanket that comprises three layers, such that a center layer, of the three layers, comprises an entry tab connected to an individual resistive heating element that comprises a flex circuit configured to couple with a source of electrical power through the entry tab; and control lines connected to the entry tab and the flex circuit arranged such that the blanket, cut to a desired shape retains an electrical connection to the entry tab.

2. The heating apparatus of claim 1, further comprising:

an outer layer, of the three layers, that comprises a flexible material.

3. The heating apparatus of claim 1, further comprising additional flex circuits in the center layer electrically coupled in parallel with each other.

4. The heating apparatus of claim 1, further comprising additional flex circuits in the center layer electrically coupled in series with each other.

5. The heating apparatus of claim 1, further comprising additional flex circuits, in the center layer, each comprise substantially identical size and shape.

6. The heating apparatus of claim 1, further comprising additional flex circuits arranged in the center layer in a two-dimensional array that comprises N rows and M columns.

7. The heating apparatus of claim 1, further comprising an array of additional flex circuits in the center layer comprise a one-dimensional array.

8. The heating apparatus of claim 1, wherein additional flex circuits in the center layer comprise a substantially constant spacing from each other.

9. A heating apparatus that comprises:

a blanket that comprises three layers such that a center layer, of the three layers, comprises a resistive printed flex heating circuit laminated between and be coupled through an entry tab with a source of electrical power, such that the resistive printed flex heating circuit comprises a plurality of individual resistive printed flex heating element circuits arranged within the blanket in a configuration such that the blanket, cut to a desired shape, maintains electrical continuity between the source of electrical power and individual resistive printed flex heating element circuits that remain within the desired shape.

10. The heating apparatus of claim 9, further comprising an outer layer, of the three layers, that comprises vulcanized silicone rubber.

11. The heating apparatus of claim 9, further comprising the individual printed flex resistive heating element circuits arranged in an array and spaced apart from each other a distance sufficient to permit the blanket to be cut between the individual printed flex resistive heating element circuits.

12. The heating apparatus of claim 11, wherein the array includes rows and columns.

13. The heating apparatus of claim 9, further comprising the individual printed flex resistive heating element circuits coupled in series with each other.

14. The heating apparatus of claim 9, further comprising the individual printed flex resistive heating element circuits coupled in parallel with each other.

15. A method of making a heating apparatus, the method comprising:

providing an electrical heat blanket having an array of individual resistive heating element circuits therein adapted to be coupled with a source of electrical power;

trimming the electrical heat blanket to a desired shape, and thereby removing at least certain individual resistive heating element circuits from the array of individual resistive heating element circuits;

severing an electrical continuity between individual resistive heating element circuits that remain in the electrical heat blanket of the desired shape; and reestablishing the electrical continuity via installing a jumper wire between two of the individual resistive heating element circuits that remain in the electrical heat blanket of the desired shape.

16. The method of claim 15, further comprising installing a second jumper wire between one of the individual resistive heating element circuits and the source of electrical power.

17. The method of claim 15, wherein reestablishing the electrical continuity includes:

exposing an electrical lead of one of the individual resistive heating element circuits by removing a portion of the electrical heat blanket surrounding the electrical lead along an edge of the heat blanket, and installing an electrical connector module on the edge of the heat blanket.

18. The method of claim 15, wherein the trimming includes cutting the electrical heat blanket along lines defined by spacing between the individual resistive heating element circuits.

19. The heating apparatus of claim 1, further comprising the flex circuit connected to the source of electrical power through an electrical bus in the blanket.

20. The heating apparatus of claim 9, further comprising the resistive printed flex heating circuit connected to the source of electrical power through an electrical bus in the blanket.

* * * * *